US006971400B1

(12) United States Patent
Bowman et al.

(10) Patent No.: US 6,971,400 B1
(45) Date of Patent: Dec. 6, 2005

(54) AIR GAP APPARATUS

(76) Inventors: Dennis E. Bowman, 17340 Walnut La., Rogers, AR (US) 72756; Steven B. Norvell, 100 Gilderbrook Rd., Greenville, SC (US) 29615

( * ) Notice: Subject to any disclaimer, the term of this patent is extended or adjusted under 35 U.S.C. 154(b) by 21 days.

(21) Appl. No.: 10/834,567

(22) Filed: Apr. 29, 2004

(51) Int. Cl.[7] ..... E03C 1/12
(52) U.S. Cl. ..... 137/216
(58) Field of Search ..... 137/216, 216.1

(56) References Cited

U.S. PATENT DOCUMENTS

| | | | |
|---|---|---|---|
| 2,878,826 | A | 3/1959 | Dolenga |
| 3,183,923 | A | 5/1965 | Henrikson |
| 3,620,241 | A | 11/1971 | Brown |
| 3,716,143 | A | 2/1973 | Clark |
| 3,786,924 | A | 1/1974 | Huffman |
| 3,856,672 | A | 12/1974 | Boswinkle et al. |
| 3,929,149 | A | 12/1975 | Phillips |
| 3,967,638 | A | 7/1976 | Tondreau |
| 4,071,445 | A | 1/1978 | Katayama et al. |
| 4,134,419 | A | 1/1979 | Richetti |
| 4,454,891 | A | 6/1984 | Dreibelbis et al. |
| 4,646,775 | A | 3/1987 | Traylor |
| 4,771,485 | A | 9/1988 | Traylor |
| 4,812,237 | A | 3/1989 | Cawley et al. |
| 4,856,121 | A | 8/1989 | Traylor |
| 4,917,847 | A | 4/1990 | Solomon |
| 4,944,877 | A | 7/1990 | Maples |
| 4,967,784 | A | 11/1990 | Barhydt, Sr. et al. |
| 5,006,234 | A | 4/1991 | Menon et al. |
| 5,176,165 | A | 1/1993 | Traylor |
| 5,305,778 | A | 4/1994 | Traylor |
| 5,713,385 | A | 2/1998 | Traylor |
| 5,721,411 | A | 2/1998 | Ervin |
| 5,875,809 | A | 3/1999 | Barrom |
| 6,193,879 | B1 | 2/2001 | Bowman |
| 6,453,931 | B1 | 9/2002 | Traylor |
| 6,510,863 | B1 | 1/2003 | Traylor |

*Primary Examiner*—Gerald A. Michalsky
(74) *Attorney, Agent, or Firm*—Reising, Ethington, Barnes, Kisselle P.C.; William J. Waugaman

(57) ABSTRACT

A dual inlet air gap fixture having an air gap body with first and second interior inlet conduits for receiving wastewater flow respectively from first and second identical or diverse sources of wastewater. The body has an interior outlet conduit opposite the inlet conduits for discharging wastewater emptying from either or both of the inlet conduits. A removable water reversal cap and partition module is received within the upper portion of the air gap body and provides venting communication between atmosphere and the outlet conduit, and redirects the wastewater from the inlet conduits into the outlet conduit. The inlet conduits are arrayed side-by-side on one side of the body interior space and the outlet conduit occupies the remaining interior space on the other side of space opposite from the two inlet conduits.

20 Claims, 5 Drawing Sheets

AIR GAP APPARATUS

FIELD OF THE INVENTION

The present invention relates to an air gap fixture particularly adapted to simultaneously or sequentially vent the wastewater discharge from two household appliances such as dishwashers, reverse osmosis (RO) systems and/or water softeners.

BACKGROUND AND OBJECTS OF THE INVENTION

Conventional kitchen sinks today often have four to six holes on the back sink ledge. Three of these may be used to accommodate a typical faucet assembly (single or double handle) usually requiring two of the three holes for incoming hot and cold water, while the third hole is normally covered by the faucet unused. When a dishwasher is located adjacent to the kitchen sink, the fourth hole is often used to accommodate an air gap designed to prevent wastewater from the dishwasher from being siphoned back into the dishwasher, and is commonly mandated by local government regulations. Such available air gaps usually consist of three elements: a one-piece molded plastic outer body having inlet and outlet conduits therein with a recess provided in the top of the outer body encompassing the upper ends of both conduits, a removable plastic splash plate fitted into or screwed onto the top of the outer body to conduct the water from the inlet conduit into the outlet conduit and can be removed for maintenance, and lastly a chrome plated or aesthetically covered vented outer cover for cosmetic reasons. A compression nut is provided for screwing onto the outer body to grip the counter top.

The wastewater discharged from a dishwasher may include solid particles such as waste food particles which sometimes escape through the dishwasher filtration system and the like, and an air gap fixture designed to accommodate such dishwasher wastewater discharge must be able to normally pass such objects through to the disposal or other drain line downstream. However, in the event such particles clog the upper end of the air gap, the air gap fixture should be easily disassembled to remove the clogged area of the apparatus and facilitate removal of the clogging objects.

Furthermore, due to the great variations of potable water quality in this country, many homeowners are installing water purification systems in their kitchen plumbing systems at significant expense. Reverse Osmosis (RO) filtration systems are commonly used as the preferred method for drinking water due to its effectiveness for treating a variety of aesthetic and health contaminants.

In RO, the semipermeable membrane through ion exclusion permits pure water to pass on one side while the higher concentration of contaminants is rejected on the other side of the membrane and rinsed to the drainage system to prevent the membrane from scaling. Any uncontrolled backflow from the drainage system thus can enter and contaminate the RO membrane and associated structure. For this reason, whenever there is drainage from an RO unit into a sewer system, plumbing codes require that backflow prevention devices, such as air gap devices, be used. Like a dishwasher drain air gap fixture, these RO air gap fixtures are designed to prevent backsiphoning or backflow of contaminated water into the RO unit.

In this regard, contaminated water is considered to be any waste or reject water downstream of the RO unit, and an acceptable backflow prevention device must prevent entry of such downstream water into the RO unit under all conceivable conditions of operation. Therefore, plumbing codes require an air gap type of backflow preventer to have a code listed air gap device in order to prevent the backsiphoning type of backflow. Plumbing codes usually also require a so-called "flood level" (F/L) to be established and permanently marked on each air gap type of faucet, with the F/L and the height location required to be at least one inch above the faucet mounting base.

However, a second conventional single inlet air gap device would also require further modification of the existing plumbing.

A similar air gap installation problem arises when it is desired to install an undercounter water softener in the vicinity of the kitchen sink and either an RO unit or dishwasher, or both, are already present. Also, some newer and increasingly popular dishwasher models have a combination of small load and full load (double) compartments which require two air gap fixtures or a twin dual inlet air gap fixture.

Although various dual purpose air gap fixtures have hitherto been provided in efforts to solve these installation problems, there remains a need for improvements in such dual purpose air gap fixtures.

Accordingly, one or more objects of the present invention include providing an improved air gap fixture that: (1) functions as a dual purpose air gap that can be installed in a new home just as easily and as inexpensively as existing air gaps, or as a retrofit that can be employed in older homes to convert its old style single purpose air gap to a dual purpose air gap; (2) is particularly adapted for rapid and easy connection to an existing RO drain tube by utilizing well known "push-in" connectors or couplers to connect the popular ⅜ or ¼ inch outer diameter polyethylene drain tubing; (3) can accommodate wastewater from both a dishwasher appliance and an RO appliance, or from a water softener and reverse osmosis appliance, or from a dishwasher appliance and a water softener appliance, or from a double compartment dishwasher appliance, or from two separate dishwasher appliances, without changing the construction of the air gap fixture, or without requiring the complicated threading of the small diameter RO tubing into the air gap fixture as in some prior art dual purpose air gap fixtures; (4) is readily disassembled from above the counter top without de-mounting the air gap fixture from the counter top to thereby facilitate cleaning and removal of clogging material; (5) is amenable to plastic injection molding manufacturing processes and equipment, is economical in construction, reliable in operation, has a long service life and is economical to manufacture, assemble, install and service, and is readily code listed to an air gap standard.

BRIEF DESCRIPTION OF THE DRAWINGS

Other objects, features and advantages of the present invention will become apparent from the following detailed description, appended claims and accompanying drawings (which are drawn to engineering scale unless otherwise indicated), in the several figures of which like reference numerals identify like elements, and wherein:

DETAILED DESCRIPTION OF PREFERRED EMBODIMENTS

Figure 1:
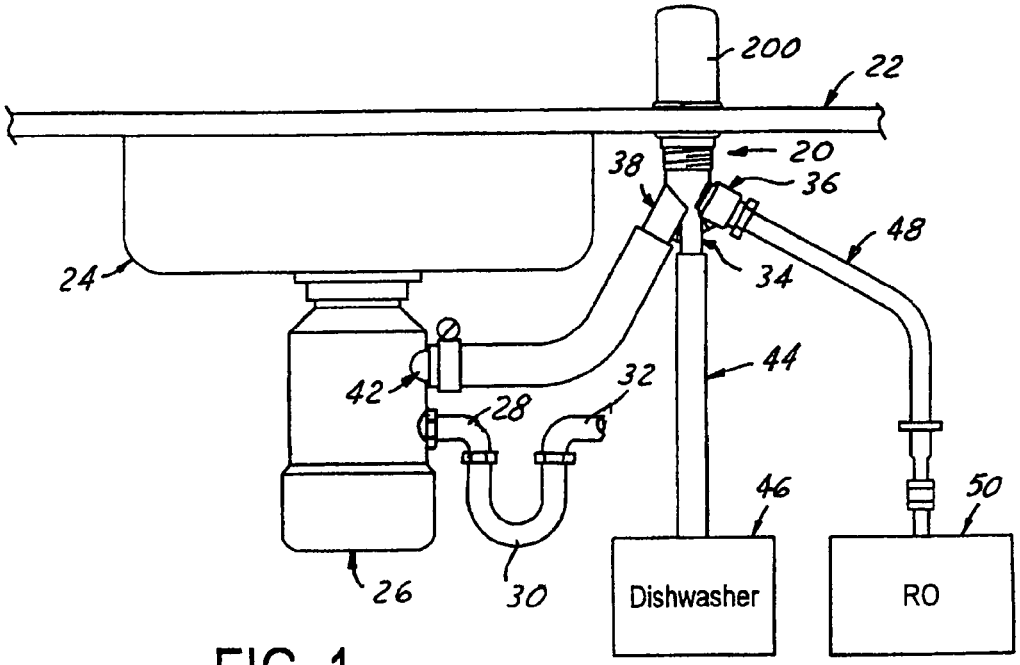
FIG. 1 is a fragmentary elevational view of a first embodiment of a typical household kitchen counter installation having a single compartment sink and a conventional garbage disposal installed therebeneath with a disposal outlet elbow connected by a conventional trap to a household waste line, and with an improved dual inlet air gap fixture of the present invention mounted to the sink counter top and coupled at its outlet side to the disposal upper side dishwasher waste inlet nipple, and with the dual inlets of the air gap fixture simultaneously coupled one to a dishwasher appliance drain outlet line and the other to an RO filter system appliance wastewater drain outlet line.

Referring now in more detail to the accompanying drawings, FIG. 1 illustrates a typical preferred but exemplary installation of an improved air gap fixture 20 of the present invention mounted on a kitchen counter top 22 adjacent the kitchen sink basin 24 that is also mounted on the counter top. In this installation example, a conventional garbage disposal 26 is mounted to the main sink drain outlet and has its outlet elbow 28 coupled to a trap 30 that in turn leads via elbow 32 to the main sewer drain of the household.

Figure 4:
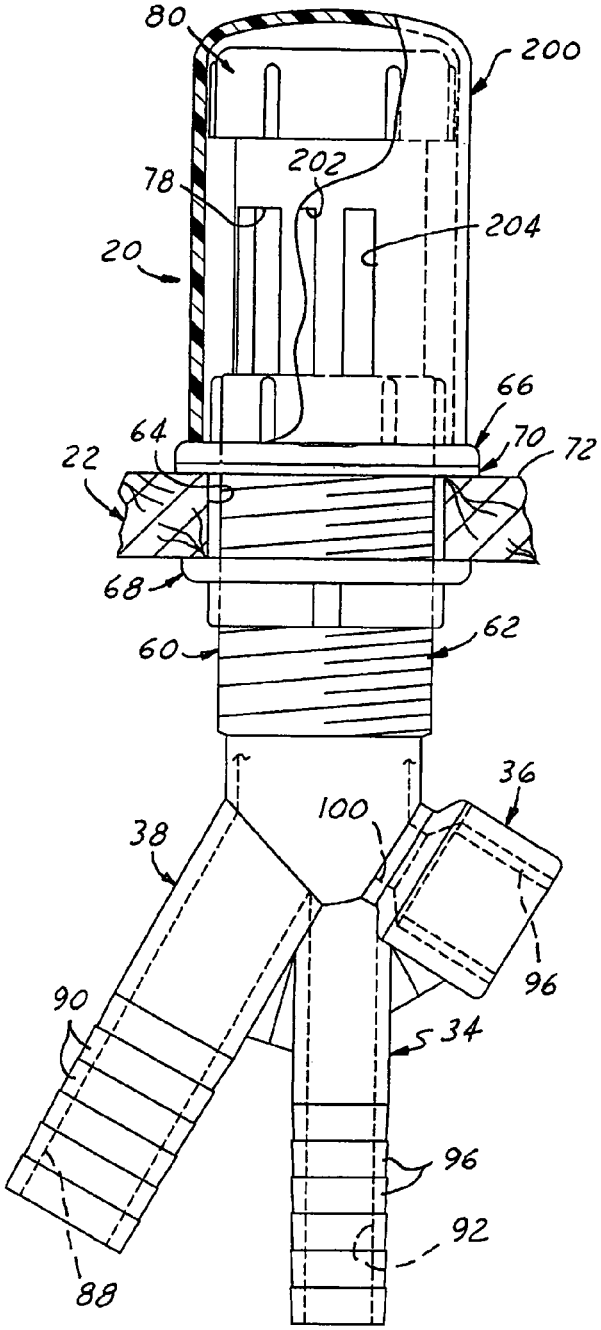
FIG. 4 is an enlarged vertical elevational front view of the air gap fixture of FIGS. 1–3 shown mounted to the kitchen sink counter top of FIGS. 1–3, and with the conventional ornamental outer vent cover cap partially broken away to better illustrate detail.

As best seen in FIG. 4, air gap fixture 20 has what is herein termed a "primary" inlet conduit comprising an external barbed inlet conduit 34, and a "secondary" inlet conduit comprising an external female (internally) threaded fitting 36, thereby providing a dual inlet air gap fixture, and a single outlet conduit that includes an external barbed outlet conduit 38.

In the undercounter hook-up illustrated in FIG. 1, the primary inlet 34 of air gap fixture 20 is coupled to the outlet of the wastewater discharge hose 44 leading from a conventional undercounter dishwasher appliance 46. The secondary inlet 36 of fixture 20 is coupled to the outlet of the wastewater discharge line 48 of the undercounter reverse osmosis installation system 50. Fixture outlet conduit 38 is coupled via a fixture outlet drain hose 40 to the disposer inlet 42, but can also be coupled to a branch-tailpiece (not shown) in the absence of a disposer. The installation of FIG. 1 thus typifies the majority of household installations.

Figure 1A:
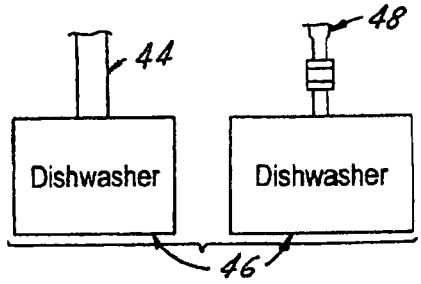
FIG. 1A is a fragmentary vertical elevational view of a portion of FIG. 1 but showing a modification wherein a second dishwasher appliance is substituted for the RO unit of FIG. 1.

FIG. 1A illustrates a modification of the system of FIG. 1 wherein a second dishwasher appliance 46' is substituted for the reverse osmosis system 50 of FIG. 1, and wherein dishwasher appliance 46' has its waste water outlet coupled to waste water discharge line 40.

It is also to be understood that the FIG. 1A modification may represent a double compartment dishwasher appliance, in which case the large load compartment is preferably represented by drawing diagram block 46 and the small load compartment by drawing diagram block 46'.

Figure 2:
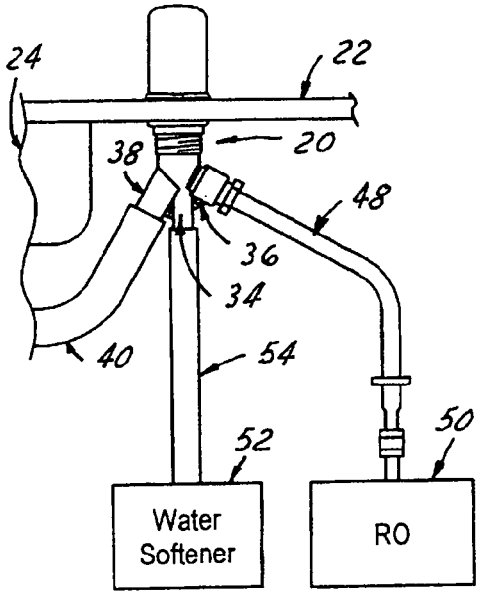
FIG. 2 is a fragmentary vertical elevational view of a portion of FIG. 1 but showing an alternate second embodiment installation hook-up of a water softener and a reverse osmosis (RO) unit to the improved dual inlet air gap fixture of the invention.

In the second embodiment installation of FIG. 2, air gap fixture 20 simultaneously accommodates the wastewater discharge of a conventional undercounter water softener 52 and the reverse osmosis unit 50. The wastewater outlet conduit 54 of water softener 52 is coupled to the fixture primary inlet 34 in this installation.

Figure 3:
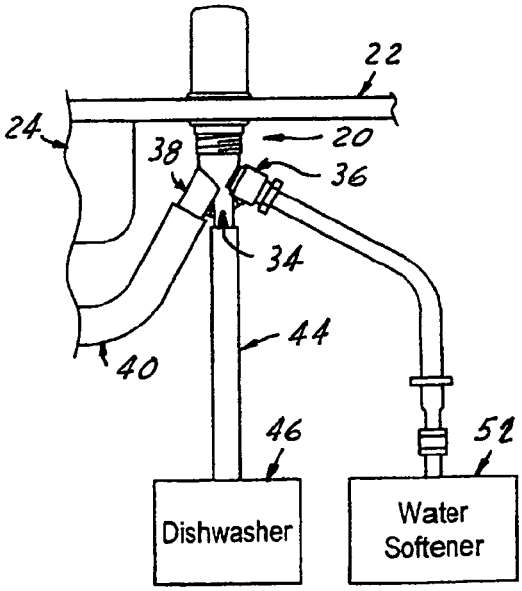
FIG. 3 is a view similar to FIG. 2 but showing a still further alternate third embodiment installation hook-up of the water discharge from a dishwasher as well as the wastewater discharge from a water softener to the improved air gap fixture of the invention.

In the third embodiment undercounter installation of FIG. 3, the dishwasher 46 has its wastewater discharge line 44 coupled to the primary inlet 34 of air gap fixture 20, as in the FIG. 1 set-up, but in this set-up a water softener 52 has its outlet 54 coupled to the secondary inlet 36 of fixture 20.

The four different installations typified by FIGS. 1, 1A, 2 and 3 thus illustrate one feature of the improved air gap fixture 20 of the present invention, namely its asymmetrical flow conduit construction wherein the undercounter appliance having the highest velocity and highest flow rate wastewater discharge is preferably coupled to the primary inlet 34 of fixture 20, and the other companion appliance having a lesser wastewater discharge flow rate and/or velocity is preferably coupled to the secondary inlet 36 of fixture 20. This asymmetrical dual inlet feature of fixture 20, in terms of its structure, function, mode of operation and advantages, will become more apparent, and better understood from the following further detailed description of fixture 20.

The exterior features of air gap fixture 20 are best seen in FIGS. 4, 5, 6 and 11. It will be seen that this preferred but exemplary embodiment of air gap fixture 20 of the invention comprises a one-piece air gap tubular body or housing 60 that is preferably injection molded as a one-piece part of plastic material such as polypropylene. Body 60 has a slightly diametrically enlarged externally threaded portion 62 preferably made approximately 1.40 inches in diameter in order to fit through a slightly larger diameter standard air gap installation hole 64 (FIG. 4) (typically 1.50 inches in diameter) provided in counter top 22 or in the metal sink ledge in accordance with conventional practice. Fixture 20 is mounted to counter top 22 or sink ledge by a conventional plastic (e.g., polypropylene) deck mount middle nut 66 that is threadably received on the upper end of body thread 62, in cooperation with a conventional undercounter bottom nut 68 also threadably received on body threaded portion 62, as best seen in FIG. 4. Preferably a conventional deck mount gasket seal 70 is provided between middle nut 66 and the upper surface 72 of counter top 22 or of the sink ledge (not shown).

Figure 5:
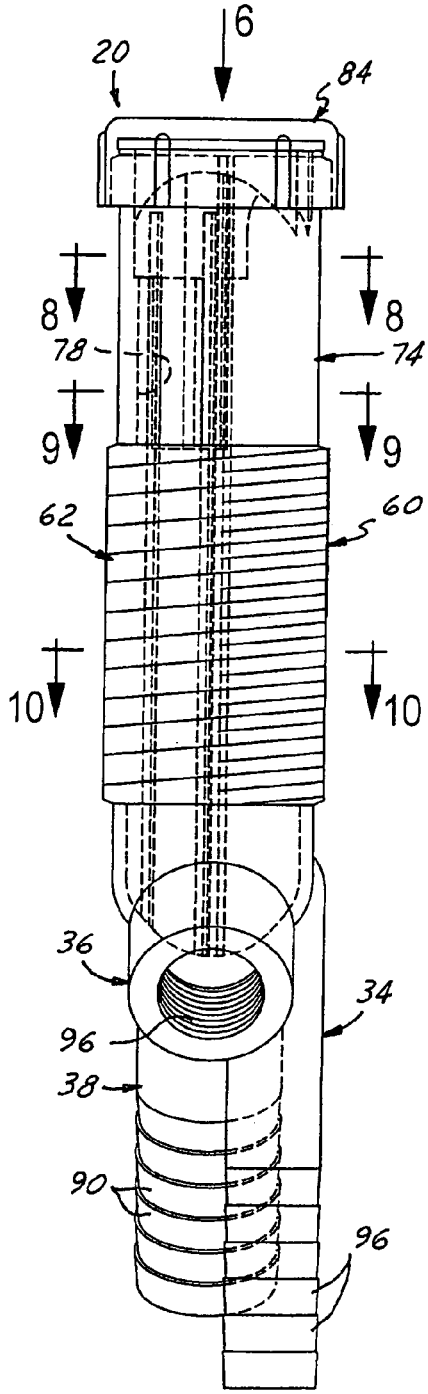
FIG. 5 is a vertical side elevational view of the improved air gap fixture of the invention as shown by itself looking at the right hand side of the fixture as viewed in FIG. 4.
Figure 6:
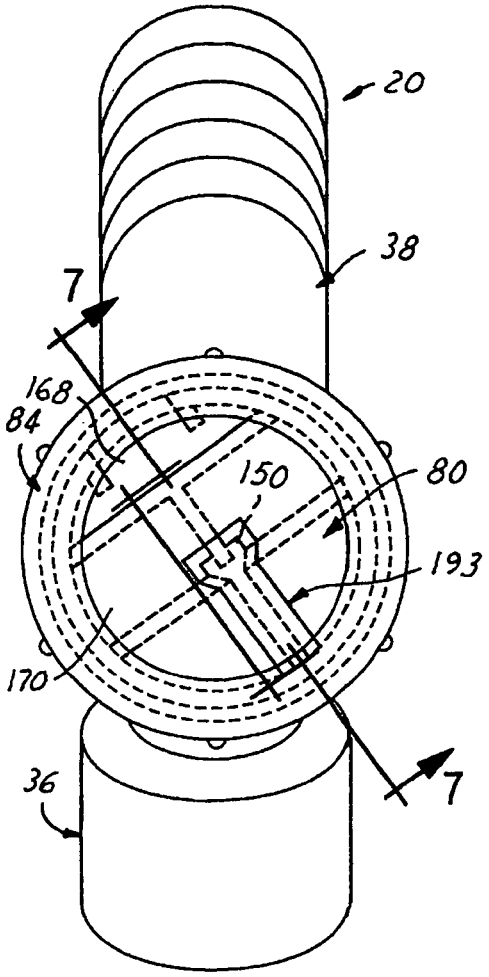
FIG. 6 is a top plan view of the fixture as shown in FIG. 5 and enlarged thereover.
Figure 11:
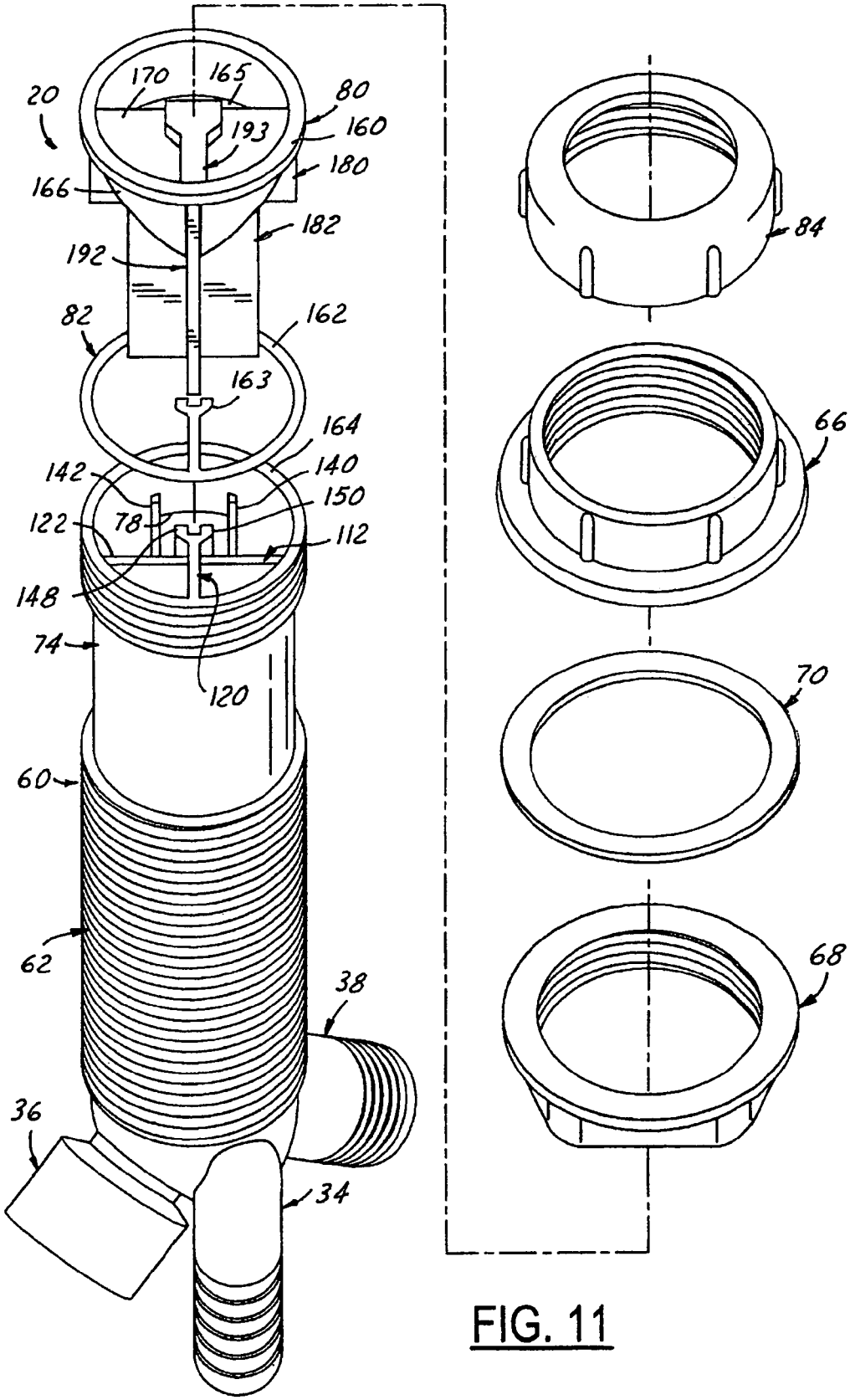
FIG. 11 is an exploded perspective view of the air gap fixture of FIGS. 1–10.

As best seen in FIGS. 5 and 11, body 60 also has an unthreaded, smooth cylindrical air gap chamber portion 74 that extends from the upper end of the threaded portion 62 for a distance axially of the body of about one and a half inch. Chamber portion 74 terminates at its upper end at another externally threaded body portion 76 (FIG. 11) provided at the extreme upper end of body 60. The upper cylindrical extension 74 of body 60 that protrudes above counter top 22 forms the outer wall of the air gap chamber of fixture 20. This chamber is vented to atmosphere by a vertically elongated rectangular slot 78 (FIGS. 4, 5, 7 9, and 11). The open upper end of body 60 is closed fluid-tight by a specially configured cap/baffle component 80 that seats on a custom O-ring seal 82 and is clamped removably in place on body 60 by a removable cap compression top nut 84 (FIGS. 4, 5, 7 and 11). Cap/baffle 80 and nut 84 are likewise injection molded of plastic material such as polypropylene.

As to the remaining exterior features of air gap fixture 20, it will be seen that the air gap external drain outlet 38 comprises a nipple in the form of a cylindrical tubular leg extending at about a 30° angle to the longitudinal central axis of body 60. Outlet nipple 38 is preferably provided with a constant diameter bore 88 (FIG. 4) and with external hose-receiving barbs 90. Fixture outlet nipple 38 is connected to the garbage disposal dishwasher drain inlet nipple 42 by the standard ⅞ inch dishwasher drain line hose 40 whose inlet end is sleeved over barbs 90 and clamped in place using non-corrosive standard hose clamps. Alternatively, the fixture discharge line 40 may be connected at its outlet to a 1½ inch by ¾ inch branch tailpiece (not shown) in the absence of a garbage disposal.

The air gap primary inlet 34 comprises a nipple in the form of a cylindrical tubular external leg having a constant diameter bore 92 (FIG. 4) that extends with its longitudinal axis parallel to but slightly offset from the central longitudinal axis of body 60. The lower half of inlet nipple 34 is provided with external barbs 96 over which, in the case of the installation embodiments of FIGS. 1 and 3, the dishwasher drain hose 44 is snuggly telescoped and clamped with a non-corrosive standard hose clamp (not shown). In the case of the installation of FIG. 2, the water softener drain hose 54 is likewise barb-coupled and clamped to primary inlet nipple 34.

Figure 10:
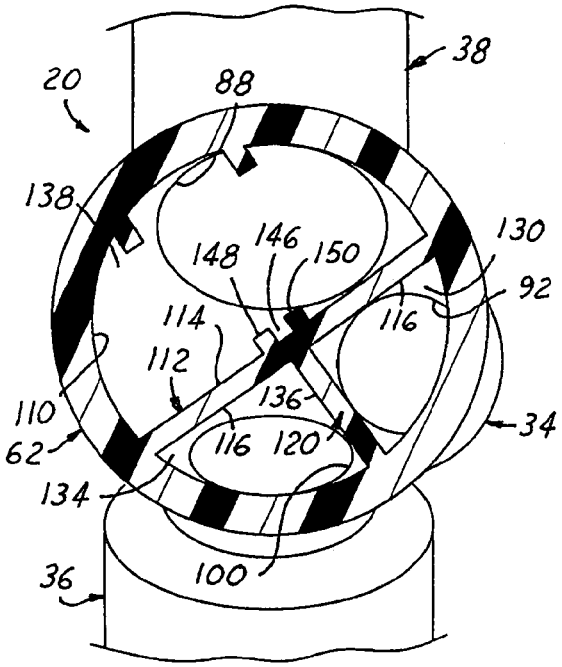

As best seen in FIGS. 5, 10 and 11, the laterally offset axis relationship of primary inlet nipple 34 is such that about 90° of its outer circumference protrudes radially outwardly beyond an imaginary vertical projection of the outer diameter of threaded portion 62 of body 60. This offset accommodates the nesting of nipple 34 relative to secondary inlet fitting 36 and discharge outlet nipple 38, while maintaining an inside diameter of bore 92 of ½ inch and not constricting its I.D. at the entrance to the interior of body 60.

The secondary inlet fitting 36 of fixture 20 is made relatively short axially but is of greater outside diameter than outlet nipple 38 in order to provide an entrance bore having ½ inch inside diameter female threads 96 (FIG. 5). The downstream outlet throat 100 (FIG. 4) of secondary inlet fitting 36 is of smaller inside diameter on the order of ¼ inch. Secondary inlet fitting 36 is thus adapted to threadably receive either of two types of conventional adapters (not shown), namely a straight adapter having one end with ½ inch male threads that threads into female threads 96, and the other end provided with a "push-in" type coupling with a collet. These straight adapters are commercially available from several sources, such as John Guest, G. A. Murdock or DMT Co. Ltd. (DMfit®), with a selection of sizes available to receive ¼ inch, ⅜ inch or ½ inch tubing with a push-in coupling to these adapter fittings. The other type of adapter is a commercially available (from several sources) stem adapter having a ½ inch externally threaded male end to be threaded into female threads 96, and an axially opposite male end provided with barbs and available in various O.D. sizes for coupling to flexible hoses with a hose clamp back-up. Typically the reverse osmosis waste line 48 would be coupled to secondary inlet fitting 36 by the straight adapter with an appropriately sized push-in coupling built in, whereas the water softener drain outlet 54 would be coupled to secondary inlet fitting 36 in the FIG. 3 hook-up using the stem adapter with the barbed male end receiving the outlet end of the water softener hose 54, again backed up by a conventional hose clamp. A similar hook-up is preferably employed in the case of second dishwasher (or small compartment dishwasher) 46'.

Figure 7:
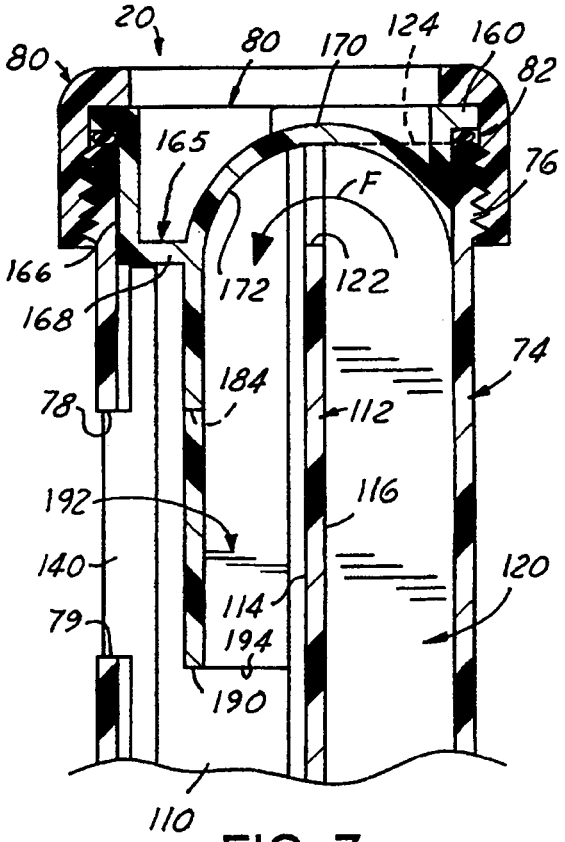
FIG. 7 is a fragmentary cross sectional view taken on the staggered section line 7—7 of FIG. 6 and enlarged thereover.
Figure 8:
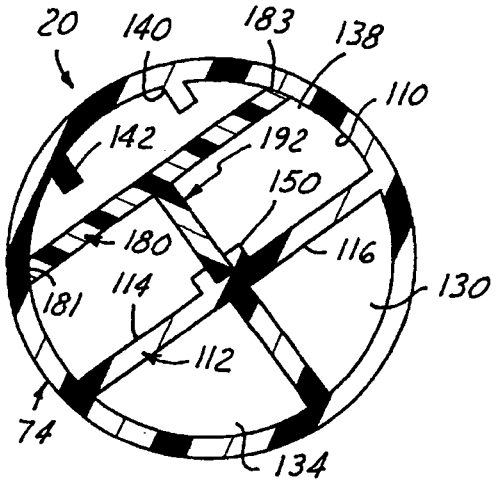
FIGS. 8, 9 and 10 are cross sectional views taken respectively on the section lines 8—8, 9—9, and 10—10 of FIG. 5 and enlarged thereover.
Figure 9:
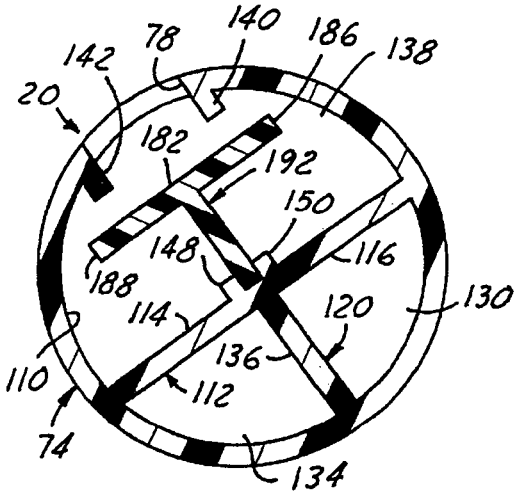

The interior structural features of body 60 of air gap fixture 20 are best seen in FIGS. 7, 8, 9 and 10. The main internal cylindrical bore 110 of body 60 is provided with a unique asymmetrical arrangement of fluid flow channels by subdividing bore 110 into three "pie-shaped" flow passages 130, 134 and 138 (FIGS. 8–10). This is accomplished by providing an internal cross wall partition 112 that extends across bore 110 chordally such that its dimension transversely of bore 110 is slightly less than the inside diameter of bore 110. The cross-sectional area of the "major" interior space forming the large flow channel 138 between the surface 114 of partition 112 that faces air vent opening 78 (FIG. 9) thus has a greater cross-sectional area than that of the interior "minor" space between the opposed surface 116 of partition 112 and the juxtaposed interior surface of bore 110. This smaller minor space, in turn, is subdivided by an integrally formed web 120 that protrudes laterally and radially outwardly from the center of partition 112 to an integral junction with bore wall 110. Web 120 thus subdivides the "minor" space into the two inlet flow channels 130 and 134.

Partition 112 extends integrally from the bottom of cylindrical body 60 and axially interiorly of body 60 up to an upper end edge 122 (FIG. 7) that is approximately flush with the lowermost thread of the external threads 76. However, web partition 120 terminates at an upper edge 124 (FIG. 7) disposed sufficiently above edge 122 so as to nest in a slot 126 provided in cap 80 (FIG. 13), as described in more detail hereinafter.

As best seen in FIG. 10, the outlet of the primary inlet bore 92 of nipple 34 leads into interior inlet flow chamber 130 (FIGS. 8, 9 and 10) that is defined laterally between surface 116 of partition 112, one side surface 132 of web 120 and the curved surface of bore 110 encompassed by surfaces 116 and 132.

Secondary inlet bore 100 of secondary inlet fitting 36 enters into an adjacent inlet flow channel 134 defined by surface 116 of partition 112, side 136 of web 120 and the juxtaposed curved surface of bore 110. Inlet flow passages 130 and 134 are thus equal in cross-sectional area to one another, but when added together are even of less cross-sectional area than the major cross sectional area of the interior drain flow channel 138 defined between surface 114 of partitions 112 and the juxtaposed curved surface of bore 110. Drain channel 138 communicates at its lower end with the junction of bore 88 of outlet nipple 38 with body 60 (FIG. 10). Thus, the body interior inlet flow channels 130 and 134 are constructed adjacent one another rather than being disposed diametrically opposed within bore 110 (i.e., they are not on opposite sides of the outlet flow channel 138 but rather together on the same side of bore 110). Thus, inlet flow channels 130 and 134 are positioned to cooperate with the side-by-side return flow baffle construction embodied in the cap 80, as described in more detail hereinafter.

Additional interior construction detail features include a pair of internal ribs 140 and 142 that extend essentially the full length of body 60 and protrude inwardly into the interior of the body in flanking relationship to the air vent opening 78. Ribs 140 and 142 thereby serve as diverters to intercept any liquid drainage flowing circumferentially along the surface of bore 110 and cause it to drain downwardly rather than to enter air vent opening 78 and thereby leak out exteriorly of drain flow channel 138.

Another interior detailed feature is the longitudinally extending groove 146 formed by a pair of laterally spaced integral ribs 148 and 150 (FIG. 10) protruding radially from surface 114 of partition 112 centrally thereof (FIGS. 8, 9 and 10) and extending longitudinally almost the full length of body 60.

Another feature resides in the cap 80 that basically performs four functions: (1) it provides a removable sealed closure for the upper end of the entire interior area encompassed by bore 110, thereby serving as a removable sealing cap for air gap fixture 20; (2) it provides an internal flow diverter for diverting the upward flow of liquid exiting the upper ends of the two inlet channels 130 and 134 through a 180° flow reversal and downwardly into the upper end of the drain channel 138, as indicated schematically by the flow arrow F shown in FIG. 7; (3) it provides a baffle partition serving to keep the two liquid streams flowing out of side-by-side inlet flow channels 130 and 134 separated from one another in the drain flow channel 138 until past the air gap opening 78; and (4) it provides a partition that prevents the liquid flowing downwardly in channel 138 from splashing out of air gap opening 78.

Figure 15:
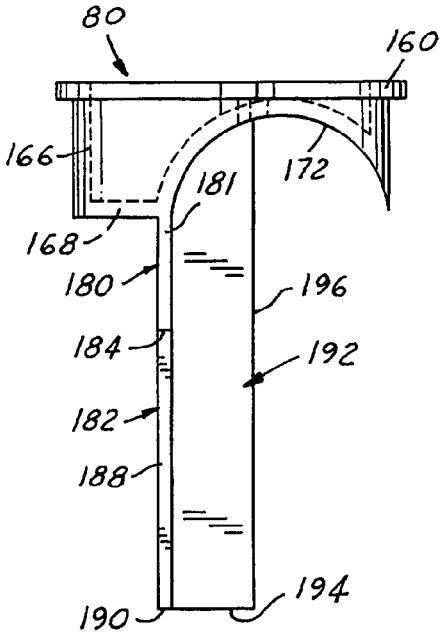
FIG. 15 is a side elevational view of the cap/baffle component of FIGS. 12–14.

The sealing/closure function of cap 80 is accomplished in part by providing an annular flange 160 (FIGS. 11, 12, 13 and 15) that seats on the circular portion 162 of O-ring 82 (FIG. 7). O-ring 82 in turn seats on the circular upper edge 164 of body 60 (FIGS. 7 and 11). Cap 80 also has an imperforate multi-contour sealing/closure wall 165 defined by a cylindrical outer periphery 166 that is interrupted at slot 126 (FIG. 13). Wall 165 also has an axially inset flat ledge portion 168 (FIG. 7) and a curved dome portion 170 (FIGS. 6 and 7), the undersurface 172 (FIGS. 12, 13 and 15) of which functions as the flow diverting barrier to produce the 180° flow reversal F (FIG. 7). The portions 168 and 170 of closure wall 165 thus provide an imperforate barrier that, along with flange 160, closes off or seals the upper end of bore 110, i.e., thereby serving the cap function of cap 80.

The curved wall dome portion 170 of cap 80 serves to reverse the liquid flow so that incoming upwardly flowing liquid in inlet flow channels 130 and 134 is redirected downwardly into the drain flow channel 138, thereby functioning as the flow diverter in the air gap fixture 20.

Figure 12:
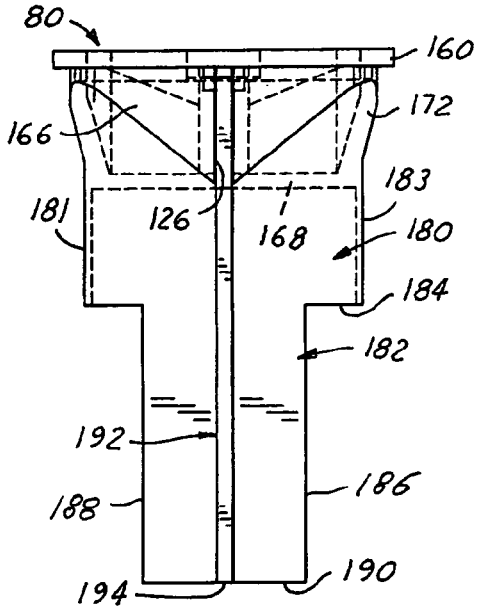
FIG. 12 is a vertical elevational view of the removable inner cap/baffle component of the air gap fixture of FIGS. 1–11 shown by itself.
Figure 13:
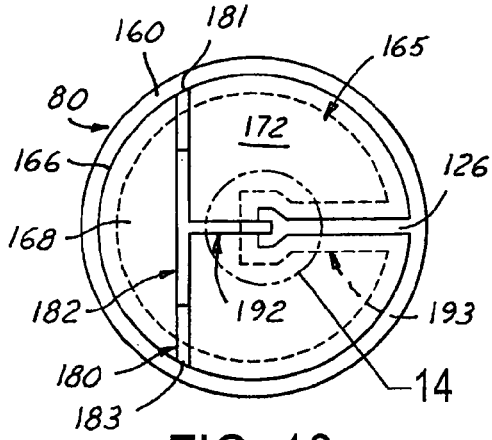
FIG. 13 is a bottom plan view of the cap/baffle component of FIG. 12.

Cap 80 also has a baffle portion formed by a vertically extending partition 180 that extends downwardly in outlet flow channel 138 and is formed as a continuation of curved wall 170 (FIGS. 7, 8, 12, 13 and 15). Partition 180 extends laterally so that its side edges 181 and 183 slidably engage opposed surfaces of bore 110, as best seen in FIG. 8. Partition 180 is integrally joined to a narrower extension partition 182 at a shoulder junction 184 that in turn is located in assembly at the same elevation as the upper edge of vent slot 78 (FIGS. 7 and 12) that serves as the main air venting opening or window of air gap fixture 20. Thus, as best seen in FIGS. 9 and 12, the narrow extension partition 182 has its side edges 186 and 188 spaced away from the interior surface of bore 110 so that a gap exists for air venting and siphon-breaking. This is in addition to the air gap area below the lower edge 190 of partition 182 and the lower edge 79 of air vent slot 78 (FIG. 7). Partitions 180 and 182 thus prevent the liquid from splashing out of the air vent opening 78 as liquid flows by gravity down drain channel 138, but also are configured to provide ample air gap venting to prevent back siphoning.

Cap 80 also has a separator partition web 192 (FIGS. 11, 12, 13 and 15) integral with partitions 180 and 182 and protruding perpendicularly therefrom radially toward partition 112 in assembly therewith (FIGS. 7–9). Partition 192 extends from an integral junction at its upper end with cap wall 170 (FIGS. 7 and 15) to a lower edge 194 flush with edge 190 of partition 182. The free vertical edge 196 of partition 192 is designed to be slidably guided in groove 146 between the partition ribs 148 and 150 described previously.

Figure 14:
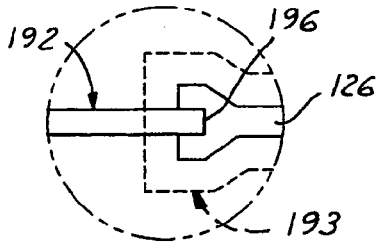
FIG. 14 is an enlarged view of the structure encompassed by the circle 14 in FIG. 13.

It is to be noted that these ribs 148 and 150 continue on upwardly as portions of partition 120 so that they terminate flush with the upper edge 164 of body 60 (FIG. 11), and thus protrude vertically above and beyond the upper edge 122 of partition 112. Hence, cap 80, at the radially inner end of cap slot 126 that accommodates the upper edge 124 of partition 120, is widened into a Y configuration to receive the upper ends of these ribs 148 and 150. Cap 80 has an integral slot-forming rib 193 (FIGS. 6, 11, 13 and 14) that protrudes upwardly from cap wall 170. Partition 192 continues into this slotted underside area of rib 193 of the cap to complete a sealing barrier between the upward flow channels 130, 134. The complementary Y-shaped widening of groove 126 in rib 193 to accommodate the upward extension of ribs 148 and 150 is best seen in the enlargement of FIG. 14. Thus, the downward return flow of primary fluid flow that came up inlet channel 130 and was diverted into drain channel 138 remains separated from the secondary fluid flow that came up inlet channel 134 and was diverted down into drain channel 138, at least until these two downward streams of return fluid have flowed past partition 180, and then substantially until they have flowed downwardly along and past partition 182 and the lower edge 194 of web 192.

Air gap fixture 20 is also provided with a standard protective vent cap 200 having one or more vent openings 202 and 204 (FIG. 4) to communicate the air vent opening 78 of chamber wall 74 of body 60 with outside atmosphere. Preferably cap 200 is a slip fit over cap nut 84 and is rotated so as to angularly displace its vent openings 202 and 204 from vent opening 78. Typically, cap 200 is chrome plated to provide desirable aesthetics on a kitchen sink installation. However, it is also intended that additional designer finishes will be provided as well in order to match sink colors and fixtures.

From the foregoing detailed description, it will be seen that the asymmetrical flow channel construction of air gap fixture 20 and the configuration of the primary inlet nipple 34 versus that of secondary inlet fitting 36 is well configured to accommodate differential flow characteristics between the primary inlet fluid and secondary inlet fluid. Nipple 34 having its central longitudinal axis parallel to that of body bore 110, and more particularly to that of body-interior inlet channel 130, and only slightly offset therefrom, offers minimum flow restriction to the primary inlet fluid exiting nipple 34 into channel 130. The secondary inlet fitting 36, being inclined with its axis at an angle of about 60° to that of bore 110, offers more pressure drop flow resistance than that of nipple 34 leading into channel 130, but does not create an appreciable pressure drop flow resistance. Although primary inlet channel 138, due to its more direct and straight flow channel, is the first choice inlet for a higher flow rate connection, the secondary inlet channel 134 with its 60° flow bend characteristic is not a functional impairment to air gap fixture 20 and its required flow characteristics. The drain downward flow channel 138 of air gap 20 offers, in cross sectional area, a multiple of that of either of the inlet channels 130 and 134, and hence channel 138 is well suited to accommodate the reduced pressure of the waste liquids and its primarily gravity-induced slower flow to the outlet opening (junction of bore 88 with the bottom of the wall of channel 138).

Another advantageous feature of air gap fixture 20 of the present invention is that it is easily cleaned in the event of a clog. Occasionally a dishwasher air gap can become clogged with leftover food debris which has escaped the dishwasher filtering mechanism. However, with fixture 20 this clogging is not a serious problem. In order to clean food particles, such as chicken and fish bones or fibrous vegetable material, which have become lodged in the inner cap spillway, it is a simple matter to pull off the outer decorative dome 200 to thereby expose top cap nut 84. Nut 84 is then unscrewed to remove it so that the inner cap 80 can be removed from body 60 by gently sliding it straight up until it is free of the body. Then any trapped food particles that are clinging to the inner cap or to the body surfaces of the flow channels 130, 134 and/or 138 can be cleaned.

Moreover, note that this fixture unclogging can be done without affecting the mounting of air gap fixture 20 on counter top 22, i.e., it is not necessary to loosen or remove either of the mounting nuts 66 and 68. In other words, it is not necessary that air gap fixture 20 be de-mounted from counter top 22 in order to clean the same, contrary to the construction of various prior art air gap fixtures.

After cleaning, the inner cap 80 is replaced carefully in the same way it was removed, taking care to align the channels and partitions of cap 80 to the channel and partitions of the air gap body 60. It is not recommended, nor is it even necessary to remove the custom O-ring 82 from cap 80. However, if the O-ring is removed, it must be properly seated in its original position so that the sealing leg 163 of the O-ring seal 82 lies on top of the upper edge of partition 120, as best seen in FIG. 11.

Another advantage of the air gap fixture 20 of the invention is that the asymmetrical flow channels provide the dual inlet flows in channels 130 and 134 side-by-side so that they exit side-by-side after being diverted by the curved diverter wall 172, and then tend to continue flowing side-by-side in outlet channel 138 until slightly past the air gap vent opening 78. Hence, there is less chance of downstream co-mingling with this novel arrangement than with constructions in which the inlet flows are arranged on opposite sides of the air gap body and tend to be directed toward one another upon entering the outlet channel, even though separated by a partition therebetween.

Although the air gap fixture 20 is a dual inlet air gap fixture and thus intended to simultaneously or sequentially accommodate wastewater flow from two different under-counter appliances, it will of course be understood that the same can be used as a single inlet air gap by plugging off whichever is to be the unused inlet 34 or 36 in the event that an installation calls for a single air gap function, either temporarily or even permanently.

The improved dual inlet air gap fixture 20 of the invention thus offers the advantage solving the problem of providing an inexpensive and simple conversion of an existing dishwasher air gap installation by providing a multi-purpose air gap that can be quickly and easily installed to vent drainage from both a dishwasher and an RO system, from a pair of dishwashers, from both compartments of a dual compartment dishwasher, from both a dishwasher and a water softener, from both a water softener and an RO system, or any dual combination thereof. The dimensions and configuration of air gap 20 provide an air gap retrofit kit that can be easily installed and used to replace an existing air gap so that a simple air gap fixture now vents more than one source of wastewater. The air gap inlet fitting 36 is also particularly adapted for fast and easy connection to existing RO drain tubing. Suitably sized well known "push-in" connectors, adapters or couplers are installed in fitting 36 by using commercially available adapters to couple the tubing to a secondary inlet fitting 36, whether it be the popular ⅜ or the ¼ inch outer diameter polyethylene drain tubing typically provided with RO systems.

Further features and advantages of the improved dual inlet air gap fixture 20 of the invention include the unique "pie-shaped" cross sectional configuration of the interior body inlet and outlet flow channels 130, 134 and 138. These channels, even when outflow is reduced in flow area by partitions 182 and 192 of cap 80, have as much as about 150% (or more) of the required area needed to pass a ⅜ inch steel ball through a conventional round cross section channel. The resultant greater cross-sectional flow area of these pie-shaped channels reduces flow back pressure, reduces the possibility of clogging and maximizes the flow channel area for a given body diameter.

Moreover, creating the pie-shaped body interior flow channels 130, 134 and 138 by using only two straight partitions 112 and 116 provides overall material savings and contributes to a higher strength-to-weight ratio in the fixture body due to the interior reinforcement strut character of these partitions.

In addition, the unique pie-shaped interior channel configuration enables the injection mold core pin slider to be made larger and stronger and therefore more durable, thereby reducing mold cost, manufacturing costs and mold maintenance costs.

Of course, providing the dual inlet air gap fixture 20 capable of simultaneously accommodating waste water discharges from two water-consuming appliances avoids the necessity of installing a second independent air gap fixture solely for serving the second of such appliances. Installing such a second air gap fixture is time consuming, expensive and unsightly because this typically requires that another hole be provided in the sink or counter top (if indeed, there is room for such) which could cause splitting or cracking of these components, and also often requires further modification of the existing plumbing.

It is to be understood that the drawings are substantially to engineering scale, and therefore the spacing between body partition 112 and cap partition 180 in the plane of the drawing in FIGS. 8 and 9 is preferably increased by about 0.100 inches over a drawing scaled dimension. The distance between edges 181 and 183 is correspondingly shortened to accommodate this dimensional change and corresponding outward shift of cap partition 180. Likewise the spacing between upper edge 122 and undersurface 172 of dome 170 of cap 80 in the plane of the drawing in FIG. 7 is increased by about 0.100 inches. These dimensional changes enable a ⅜ inch diameter steel ball to readily pass through all interior body and cap inlet and outlet flow passages to thereby easily meet applicable UP and ACSE codes that apply to air gap fixtures. Such codes require that the diameter of the air gap body, including the diameters of the outlet conduit and the inlet conduit or conduits, and the orientation of such components, be such that they will allow passage of a 5⁄16 inch or a ⅜ inch inspection ball through such components, starting with the inlet conduit and ending with the outlet conduit.

It is also to be understood that, although the foregoing description and drawings described and illustrated in detail various preferred embodiments of the present invention, to those skilled in the art to which the present invention relates the present disclosure will suggest many modifications and constructions as well as widely differing embodiments and applications without thereby departing from the spirit and scope of the invention. The present invention therefore is intended to be limited only by the scope of the appended claims and the applicable prior art.

What is claimed is:

1. In an air gap fixture comprising an air gap body which includes a hollow upwardly open upper portion and a lower portion having first and second inlet conduits for receiving wastewater respectively from first and second sources of wastewater, and an outlet conduit for discharging wastewater from either or both of said sources, a water reversal module received within the upper portion of the air gap body and including an air gap structure providing communication between the atmosphere and the hollow interior of the air gap body leading to the outlet conduit, and further including means for redirecting the wastewater from the inlet conduits downwardly through the hollow air gap body and into the outlet conduit, the improvement characterized by said first and second inlet conduits being constructed and arranged side-by-side on the same side of the body and the outlet conduit being constructed and arranged to occupy the remaining interior space of the body and thus is disposed primarily on the other side of the body opposite from the two inlet conduits.

2. The air gap fixture as set forth in claim 1 wherein said module comprises a removable cap closing the upper end of the body and adapted to seal off the upper end of the body, said cap carrying reverse flow directing baffle means for receiving upward flow from the two inlet conduits and redirecting it down the outlet conduit, and wherein the cap further comprises a partition for keeping the return flows from the two inlet conduits separated in the outlet conduit for at least a critical portion of their descent therein in order to prevent cross-contamination as well as being separated from an air gap vent opening in said body.

3. The air gap fixture as set forth in claim 2 wherein the first inlet conduit comprises a primary inlet conduit having an inlet nipple extending exteriorly of said body with its longitudinal axis generally parallel to that of the body, and wherein the second inlet conduit comprises a secondary inlet fitting extending exteriorly of said body and angled with its longitudinal axis at approximately 60° to that of said body, and wherein said outlet conduit has an outlet nipple extending exteriorly of said body and angled with its longitudinal axis at approximately 30° to that of the body.

4. The air gap fixture as set forth in claim 3 wherein said secondary inlet conduit fitting has an internally threaded bore adapted to receive a threaded adapter having one end provided with male threads adapted to be screwed into said secondary inlet fitting and having an axially opposite end comprising one of various types of male or female couplings.

5. A household installation combination of said air gap fixture of claim 4 mounted on a kitchen counter top or on a kitchen sink basin mounted adjacent said fixture, a garbage disposer mounted to a drain outlet of said sink and having an upper side inlet and an outlet elbow coupled to a drain trap that in turn leads to the main sewer drain of the household, and wherein said installation comprises in further combination therewith one of the following four appliance wastewater hook-ups:

(1) a first hook-up, wherein said fixture simultaneously accommodates the waste water discharge of a dishwasher and that of an RO unit, said primary inlet of said fixture being coupled to the outlet of a wastewater discharge hose leading from said dishwasher, said secondary inlet of said fixture is coupled to the outlet of the wastewater discharge line of said RO unit, and said fixture outlet conduit is coupled via a fixture outlet drain hose to the upper side inlet of said disposer, (2) a second hook-up wherein said fixture simultaneously accommodates the wastewater discharge of a water softener and an RO unit, the wastewater outlet conduit of the water softener being coupled to the said primary inlet of said fixture, and said RO unit being coupled the same as the RO unit in said first hook-up, (3) a third hook-up wherein a dishwasher has its wastewater discharge line coupled to said primary inlet of said fixture, as in the first hook-up, and a water softener has its outlet coupled to said secondary inlet of said fixture, and (4) a fourth hook-up wherein said fixture simultaneously accommodates the waste water discharge from each of a pair of dishwasher appliances or from each of the large and small load compartments of a dual compartment dishwasher appliance, the primary inlet being coupled to the waste water discharge of said one of dishwasher appliances or to the waste water discharge of said large load compartment, and the secondary inlet being coupled to the waste water discharge of said other of said dishwasher appliances or to that of the small compartment.

6. The fixture as set forth in claim 4 in combination with first and second wastewater discharging undercounter appliances, said first appliance having a given velocity and/or flow rate of rated wastewater discharge and being coupled to said primary inlet nipple of said fixture, and said second appliance having a given velocity and/or flow rate of rated wastewater discharge less than that of said first appliance and being coupled to said secondary inlet fitting of said of fixture.

7. The fixture of claim 4 wherein said body comprises an air gap tubular body injection molded as a one-piece part of plastic material such as polypropylene, said body having a slightly diametrically enlarged first external thread portion preferably made approximately 1.40 inches in diameter in order to fit through a 1.425 to 1.500 inches diameter standard air gap installation hole provided in a kitchen sink ledge or in a counter top, said fixture being adapted to be mounted to the ledge or counter top by a conventional plastic (e.g., polypropylene) deck mount middle nut, that is threadably received on first external thread portion, in cooperation with a conventional undercounter bottom nut also threadably received on said first external thread portion, said body also having an unthreaded, smooth cylindrical air gap chamber portion that extends from the upper end of said first thread portion for a distance axially of the body of about one and a half inch, said body chamber portion terminating at its upper end at a second external body thread portion provided at the extreme upper end of said body, said upper air chamber portion protruding above the sink ledge or counter top and forming the outer wall of the air gap chamber of said fixture and being vented to atmosphere by a vertically elongated rectangular slot therein, an open upper end of said body being closed fluid-tight by a cap/baffle component that seats on a custom O-ring seal and being clamped removably in place on said body by a removable cap compression top nut, said cap/baffle and said top nut likewise being injection molded of plastic material such as polypropylene.

8. The fixture of claim 3 wherein said external drain outlet conduit comprises a nipple in the form of a cylindrical tubular leg extending at about said 30° angle to the longitudinal central axis of said body, said outlet nipple having a constant diameter bore and external hose-receiving barbs, said fixture outlet nipple being adapted to be connected to a garbage disposer dishwasher drain inlet by the outlet end of a standard ⅞ inch drain line hose whose inlet end is sleeved over said outlet nipple barbs and clamped in place by one or more non-corrosive standard hose clamps, or alternatively, adapted to be connected by said drain line hose coupled at its outlet to a 1½ inch by ¾ inch branch tailpiece in the absence of a garbage disposer.

9. The fixture of claim 8 wherein said air gap primary inlet conduit comprises a nipple in the form of a cylindrical tubular external leg having a constant diameter bore that extends with its longitudinal axis parallel to but slightly offset from the central longitudinal axis of said body, the lower half of said inlet conduit having nipple external barbs adapted to receive a dishwasher drain hose snuggly telescoped and clamped thereon with a hose clamp, or likewise a water softener drain hose barb-coupled and clamped to said primary inlet nipple.

10. The fixture of claim 9 wherein the laterally offset axis relationship of said primary inlet conduit nipple is such that about 90° of its outer circumference protrudes radially outwardly beyond an imaginary vertical projection of the maximum outer diameter of said body to thereby accommodate a nested array of said primary inlet conduit nipple relative to said secondary inlet fitting and said discharge outlet nipple while maintaining an inside diameter (I.D.) of said primary inlet conduit nipple bore of ½ inch and thus not constricting its I.D. at the entrance thereof to the interior of said body.

11. The fixture of claim 10 wherein said secondary inlet fitting is made relatively short axially but is of greater outside diameter than said outlet nipple in order to accommodate an entrance bore in said secondary inlet fitting having ½ inch inside diameter female threads, said inlet fitting having a downstream outlet throat of smaller inside diameter on the order of ¼ inch, whereby said secondary inlet fitting is thus adapted to threadably receive either of two types of conventional adapters, namely (1) a straight adapter having one end with ½ inch male threads that threads into said female threads, the other axially opposite end of said straight adapter being provided with a "push-in" type coupling with a collar in a selection of sizes available to receive ¼ inch, ⅜ inch or ½ inch tubing with a push-in coupling, or (2) a commercially available stem adapter having a ½ inch externally threaded first male end to be threaded into said female threads, and an axially opposite second male end to receive the female end of a quick connect fitting, or (3) a commercially available adapter having a like first end but with a second male end provided with barbs and available in various O.D. sizes for coupling to a flexible hose with a hose clamp back-up.

12. The fixture of claim 2 wherein said body has a main internal cylindrical bore having a laterally asymmetrical arrangement of longitudinally extending fluid flow channels wherein said main bore is subdivided into three flow passages by providing an internal cross wall partition that extends transversely across said main bore chordally such that its dimension transversely of said main bore is slightly less than the inside diameter of said main bore such that a first surface of said cross wall partition and the juxtaposed most distant bore interior surface form a flow channel cross-sectional area defining a majority of the interior space and thereby forming said outlet conduit as a large interior drain flow channel, said first surface of said cross wall partition facing said air vent opening, a minority of the interior space being that defined between an opposite side surface of said cross wall partition and the juxtaposed less distant bore interior surface, and wherein this minority area space in turn is subdivided by an integrally formed web that protrudes laterally and radially outwardly from the center of said second side surface of said cross wall partition to an integral junction with said juxtaposed less distant interior surface of said main bore such that said web subdivides the minor space into primary and secondary inlet flow channels to thereby respectively provide the portion of said first and second inlet conduits that extend within said bore.

13. The fixture of claim 2 further including a pair of internal ribs that extend essentially the full axial length of said body and protrude inwardly into the interior of said body in flanking relationship to said air vent opening such that said ribs serve as diverters to intercept any liquid drainage flowing circumferentially along the interior surface of said body bore and cause it to drain downwardly rather than to enter said air vent opening and thereby leak out exteriorly of said interior drain outlet flow channel.

14. The fixture of claim 2 wherein said body has a longitudinally extending groove formed by a pair of laterally spaced groove-defining integral ribs protruding radially from the center of a surface of an interior cross wall partition, that separates said outlet conduit from said inlet conduits, and into the interior drain flow channel and extending longitudinally almost the full length of said body for receiving in assembly a divider web extending from said partition of said cap.

15. The fixture of claim 2 wherein said cap is constructed and arranged such that it performs at least four functions: (1) it provides a removable sealed closure for the upper end of the entire interior area encompassed by said body main bore, thereby serving as a removable sealing cap for said fixture; (2) it provides an internal flow diverter for diverting the upward flow of liquid exiting the upper ends of the two inlet conduits through a 180° flow reversal and downwardly into the interior upper end of the outlet conduit; (3) it provides a baffle partition serving to keep the two liquid streams flowing side-by-side out of the inlet conduits separated from one another in the interior outlet conduit until past the air gap opening; and (4) it provides a partition that prevents the liquid flowing downwardly in the outlet conduit from splashing out of the air gap opening.

16. The fixture of claim 15 wherein the sealing/closure function of said cap is accomplished in part by providing an annular flange on the upper end of said cap that seats on a circular portion of an O-ring that in turn seats on a circular upper edge of said body, said cap also having an imperforate multi-contour sealing/closure wall defined by a cylindrical outer periphery that is interrupted at a radial slot, said closure wall also having an axially inset flat ledge portion and a curved dome portion, the undersurface of which functions as the flow diverting curved wall barrier to produce said 180° flow reversal, said flat ledge portion and said curved wall dome portion of said closure wall thus together providing an imperforate barrier that, along with said cap flange, closes off or seals the upper end of said bore, i.e., thereby serving the cap function of said cap, said curved wall dome portion of said cap also serving to reverse the liquid flow so that incoming upwardly flowing liquid in said interior inlet flow channels is redirected downwardly into the interior outlet drain flow channel, thereby functioning as the flow diverter in the said gap fixture.

17. The fixture of claim 16 wherein said cap also has a baffle portion formed by a vertically extending major partition that extends in assembly downwardly in said interior outlet conduit and is formed as a continuation of said cap curved wall barrier, said major partition extending laterally so that its side edges slidably engage opposed surfaces of said main bore, said major partition being integrally joined to a narrower dependent extension minor partition at a shoulder junction that in turn is located in assembly at generally the same elevation as the upper edge of the air gap vent slot, said narrow extension minor partition thus having its side edges spaced away from the interior surface of said main bore so that a gap exists for air venting and siphon-breaking in addition to an air gap area below a lower edge of said minor partition and the lower edge of said air vent slot, whereby said partitions thus prevent liquid from splashing out of said air vent opening as liquid flows down said interior outlet conduit but also are configured to provide ample air gap venting to prevent back siphoning and cross-contamination.

18. The fixture of claim 17 wherein said cap also has a separator partition web integral with said major and minor cap partitions and protruding perpendicularly therefrom radially toward a body cross wall interior partition in assembly therewith, said cap partition web extending from an integral junction at its upper end with said cap curved wall barrier to a lower edge flush with said lower edge of said cap minor partition, a free vertical edge of said cap web partition being designed to be slidably guided in a groove defined between integral groove-defining ribs formed on said cross wall partition.

19. The fixture of claim 18 wherein said groove-defining ribs continue on upwardly as portions of said body cross wall partition web so that they terminate flush with the upper edge of said body and thus protrude vertically above and beyond the upper edge of said body cross wall partition, said cap having a radial cap slot that receives in assembly the upper edge of said body cross wall partition web, said cap slot having at its radially inner end a Y configuration to receive the upper ends of said groove-defining ribs, said cap having an integral slot-forming exterior rib that protrudes upwardly from the exterior of said cap barrier wall, said body cross wall partition web continuing into an upwardly slotted underside area of said exterior rib of said cap to complete a cap sealing barrier for the outlet ends of said interior inlet conduits.

20. The fixture of claim 1 wherein the first inlet conduit comprises a primary inlet conduit having an inlet nipple extending exteriorly of said body with its longitudinal axis generally parallel to that of the body, and wherein the second inlet conduit comprises a secondary inlet fitting extending exteriorly of said body and angled with its longitudinal axis at approximately 60° to that of said body, and wherein said outlet conduit has an outlet nipple extending exteriorly of said body and angled with its longitudinal axis at approximately 30° to that of the body, and wherein an outlet of a primary inlet bore of said primary inlet nipple leads into the interior of said primary inlet flow chamber and wherein a secondary inlet bore of said secondary inlet fitting enters into said secondary inlet flow channel, said inlet flow channels being substantially equal to one another in cross-sectional area but when added together are even of less cross-sectional area than the major cross sectional area of the interior drain flow channel of said outlet conduit, and wherein said interior drain channel communicates at its lower end with the junction of a bore of said outlet nipple with said body.

* * * * *